United States Patent [19]

Taylor

[11] 4,342,152

[45] Aug. 3, 1982

[54] METHODS OF TERMINATING AND CONNECTORIZING CABLES

[75] Inventor: Thomas J. Taylor, Gahanna, Ohio

[73] Assignee: Western Electric Company, Inc., New York, N.Y.

[21] Appl. No.: 116,704

[22] Filed: Jan. 30, 1980

[51] Int. Cl.[3] ..... H01R 43/02

[52] U.S. Cl. ..... 29/860; 29/857; 339/176 MF

[58] Field of Search ..... 29/860, 861, 857, 863, 29/622; 339/17 F, 19, 22 B, 176 MF, 275 T, 196 M; 174/75 R, 74 R

[56] References Cited

U.S. PATENT DOCUMENTS

| | | | |
|---|---|---|---|
| 2,434,740 | 1/1948 | Glaser et al. | 339/5 R |
| 3,015,082 | 12/1961 | Meacham . | |
| 3,126,619 | 3/1964 | Brent | 29/860 |
| 3,333,669 | 8/1967 | Schaefer | 113/119 |
| 3,573,719 | 4/1971 | Lightner | 339/196 M |
| 3,641,482 | 2/1972 | Bretting | 339/196 M |
| 3,936,933 | 2/1976 | Folk et al. . | |
| 3,999,289 | 12/1976 | Büttner et al. . | |
| 4,071,289 | 1/1978 | Szudarek . | |

FOREIGN PATENT DOCUMENTS

| | | | |
|---|---|---|---|
| 1125984 | 12/1960 | Fed. Rep. of Germany | 174/68.5 |
| 1181785 | 11/1964 | Fed. Rep. of Germany | 29/622 |
| 1490066 | 7/1969 | Fed. Rep. of Germany | 29/622 |

*Primary Examiner*—Francis S. Husar

*Assistant Examiner*—Carl J. Arbes

*Attorney, Agent, or Firm*—K. R. Bergum

[57] ABSTRACT

Several flat cable assembly embodiments (10, 30, 60) are disclosed, as are methods for terminating and connectorizing the terminating ends of ribbon-shaped conductors (13, 33, 34, 63) arranged in at least one laterally disposed array in a flat cable (12, 32, 62). In accordance with all of the flat cable assembly embodiments, terminated insulation-stripped conductor end portions (13*a'*, 33*a'*, 34*a'*, 63*a'*) are twisted angularly a predetermined number of degrees from their initial orientation, as originally confined within the cable, prior to being secured to respectively associated connector mating elements of either the solder type (19, 44), or solderless type (64).

With respect to effecting solder type connections with connector elements in the form of U-shaped solder receptacles (19, 44), in particular, the stripped ribbon-shaped conductor end portions are preferably twisted approximately 90 degrees prior to being nested in the receptacles, with the major surfaces of the then loosely nested end portions (13*a'*, 33*a'*, 34*a'*) being fully exposed to molten solder (24,54) when subsequently deposited in the receptacles. Such an angular twisting operation also advantageously reduces the relatively high elastic moduli otherwise exhibited by the ribbon-shaped conductors whenever additionally displaced laterally relative to each other as often required in order to establish multi-conductor-receptacle alignment.

16 Claims, 9 Drawing Figures

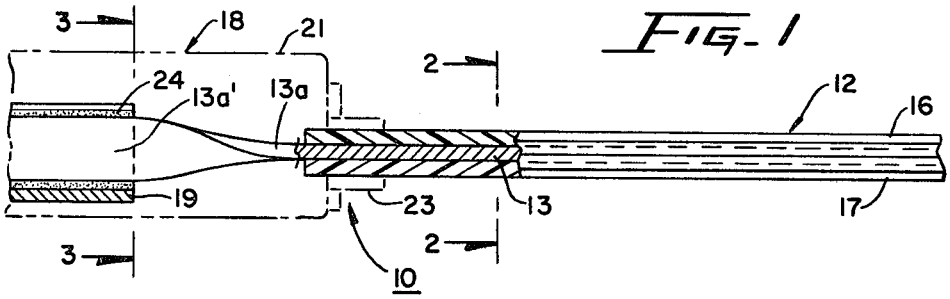
FIG. 1
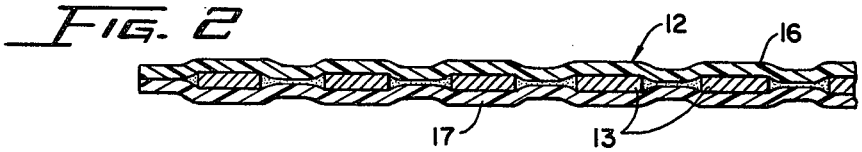
FIG. 2
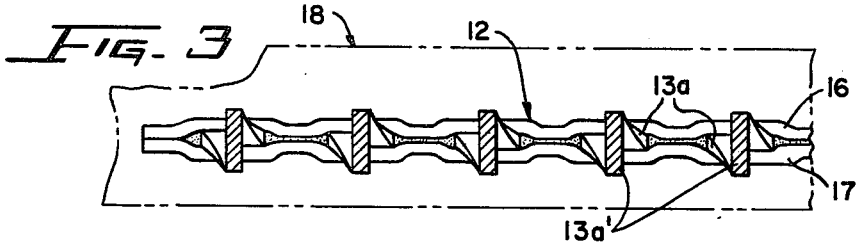
FIG. 3
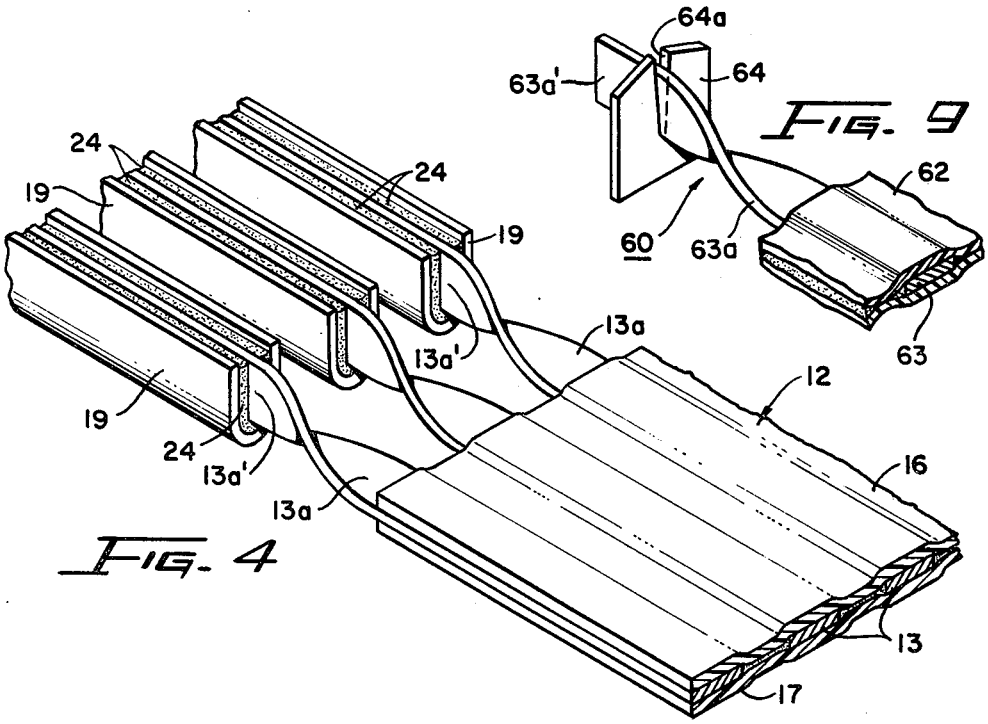
FIG. 9
FIG. 4

7
43
54
33a'
33a
6
32
41
37
33
44
34a
46
42
36
34
38
34a'
54
6
30
7
47

32
37
33
36
38
34

43
33a'
33a
37
36
38
34a
34a'

54
44
54
44
33a'
33a
32
37
44
36
54
33
34a'
34
34a
41
38
42

METHODS OF TERMINATING AND CONNECTORIZING CABLES

BACKGROUND OF THE INVENTION

1. Field of the Invention

This invention relates to the connectorization of flat cable and, in particular, to such cable of the type having one or more arrays of rectangularly shaped conductors.

2. Background of the Invention

In many types of flat cable, such as intended for use in telephone under-carpet cable, one such cable being known as TUCC* flat cable (*registered trademark of the Western Electric Company), the conductors are often of rectangular or ribbon configuration. Such conductors are particularly advantageous in allowing a given flat cable to be fabricated with minimum thickness. This becomes of paramount importance when such cables are fabricated with multiple conductor arrays, and/or when they must be folded back upon themselves in certain under-carpet wiring applications.

Flat cables of the type in question have generally been connected to conventional solder type connectors, in particular, heretofore by first stripping the insulation from short, terminated end sections of the conductors, and then positioning them in, and soldering them to, respectively aligned U-shaped solder cups or receptacles. With the insulation-stripped ends of the ribbon conductors normally having been positioned within the receptacles heretofore in essentially the same horizontal plane as confined within the cable, i.e., with their major surfaces extending across the width dimension of the receptacles, only the upper major surface of each conductor has been exposed to the molten solder subsequently deposited within the associated receptacle. This follows from the fact that the width of each receptacle hardly ever is much greater than the width of a stripped conductor end, because of very stringent connector receptacle spacing requirements. As such, it has been very difficult heretofore to cause the molten solder to reliably flow around the edges of a given nested conductor end so as to fill the typical semi-circular void otherwise established between the underside surface of the conductor end and the immediately adjacent sidewall surface area of the connector receptacle. Moreover, because of the normally close-fitting relationship that has existed between the terminated conductors and receptacles heretofore, considerable care has also been required in carrying out the aligning and nesting operations therebetween.

Terminated ribbon-shaped conductors have also often presented a troublesome alignment problem heretofore whenever the spacings therebetween have not corresponded to the spacings of the connector receptacles (or contacts of any other type). Considered more specifically, a rectanguarly shaped conductor inherently exhibits a relatively high elastic modulus along its major plane. Thus, it is quite difficult to displace such a conductor, and maintain such displacement, by a predetermined amount in a direction away from its longitudinally disposed axis, while remaining in the major plane thereof.

A technique employed heretofore to connectorize an intermediate segment (as distinguished from terminating end) of a given length of flat cable, with ribbon conductors, has involved a conductor twisting operation. More specifically, in U.S. Pat. No. 4,071,289, of Robert G. Szudarek, the insulation is removed from an array of conductors along an intermediate segment of the cable, with the resulting short, exposed conductor segments then being twisted 90 degrees so as to acquire an orientation that is substantially perpendicular to the original (horizontal) orientation thereof as confined within the fabricated cable. A specially constructed conductor-shielding housing is then employed which allows longitudinally staggered access to selected ones of the twisted conductor segments through the utilization of frictionally engaging socket-type terminals.

U.S. Pat. Nos. 3,936,933, of K. F. Folk et al., and 3,999,289, of K. Büttner et al., constitute considerably more remote techniques concerned with re-positioning the terminated wire ends confined within a round (as distinguished from flat) cable so as to facilitate the attachment of the wires thereof to a utilization device (e.g., a connector or plug). This is accomplished by fanning out the wire ends along a common plane, with no intended twisting thereof being involved.

J. W. Meacham U.S. Pat. No. 3,015,082 discloses a remotely related plug-in busway wherein a plurality of heavy gauge strap-like bus bars have portions thereof twisted 90 degrees so as to provide male-female plug-in access thereto in high power electrical system applications. Such a busway, of course, in no way suggests a solution to the problems described hereinabove that are involved in terminating and preferably solder-securing the ends of one or more arrys of minute, and fragile, ribbon-like conductors of a flat, flexible cable to a mating miniaturized connector.

SUMMARY OF THE INVENTION

It, therefore, is an object of the present invention to provide simplified, inexpensive and reliable methods of terminating and connectorizing a flat cable having ribbon-like conductors, and a cable-connector assembly produced thereby.

In accordance with the principles of the present invention, the above and other objects are realized in the soldered connectorization of one preferred flat cable-connector assembly embodiment wherein the insulation-stripped, ribbon-shaped conductor ends of a flat cable are angularly twisted a predetermined number of degrees, preferably in the range of 45 to 90 degrees, from their original (horizontal) orientation, as confined within the cable, prior to being secured within respectively associated and typically U-shaped receptacles of a solder type connector.

A primary advantage of such a twisting operation is that upon each re-oriented and stripped conductor end being nested within an associated connector receptacle, the major surfaces of the former are advantageously fully exposed to the subsequent receptacle-deposited molten solder. This results because of the initial voids or spaces established between each re-oriented and relatively loosely nested conductor end and the adjacent inner sidewall surface areas of the associated receptacle. With the solder filling such initially established voids, very reliable and consistent soldered conductor-receptacle connections are formed. In addition, the resulting solder fillets are fully exposed for visual inspection.

A concomitant advantage derived from the solder-related connectorizing methods embodied herein is that they obviate the need for relatively expensive and specially constructed fixturing otherwise normally required to align and force-fit the stripped conductor ends, if maintained in their original common horizontal positions, into the then close-fitting associated U-shaped connector receptacles.

Twisting the terminated conductor ends approximately 90 degrees from their original orientation may often also prove particularly desirable whenever lateral displacement of the conductors is additionally required for conductor-receptacle alignment. Any such alteration in conductor spacing may be effected either simultaneously with, or following, the twisting operation, so as to reduce the otherwise relatively high elastic moduli exhibited by the conductors, utilizing either manually operated or completely automated apparatus.

One particular illustrative example where it may often be desirable to effect both a 90 degree twist and a predetermined degree of lateral displacement of a plurality of terminated flat cable conductors, is in the connectorization of a multi-conductor cable of the type wherein two precisely offset arrays of overlying/underlying rectangularly-shaped conductors are separated by a center film, with each array being laminated between the common center film and a different one of two outer films. Such a cable is disclosed in a co-pending application of W. A. Elliott-T. J. Taylor, Ser. No. 106,599, filed Dec. 26, 1979, and assigned to the same assignee as the present invention.

Twisting the conductor ends of flat cable 90 degrees, with or without accompanying lateral displacement, also may be of particular advantage, in accordance with another illustrative embodiment of the invention, in effecting solderless connections with connector contacts of the type having resilient, frictionally engaging conductor-receiving slots.

BRIEF DESCRIPTION OF THE DRAWINGS

FIG. 1 is a side elevational view, partially in section, of a first illustrative flat cable assembly embodiment wherein the terminated stripped ends of a single array of ribbon-like conductors are shown twisted approximately 90 degrees from their original common orientation so as to facilitate the connecting thereof to a solder-type connector in accordance with the principles of the present invention;

FIG. 2 is fragmentary cross-sectional view of the flat cable of FIG. 1, taken along the line 2—2 of that FIG.;

FIG. 3 is a fragmentary cross-sectional view of the flat cable of FIG. 1, taken along the line 3—3 of that FIG., showing the forward portions of the stripped conductor ends after having been twisted 90 degrees to facilitate their connectorization.

FIG. 4 is an enlarged, fragmentary, perspective view of a portion of the cable assembly of FIG. 1, and illustrates the manner in which the stripped and twisted conductor ends of the cable are nested in, and soldered to, respectively associated receptacles of the connector;

FIG. 9 is an enlarged, fragmentary detail view of a flat cable wherein a twisted and stripped conductor end thereof is force-fit into an illustrative bifurcated contact of a solderless type connector.

DETAILED DESCRIPTION OF THE INVENTION

Figure 5:
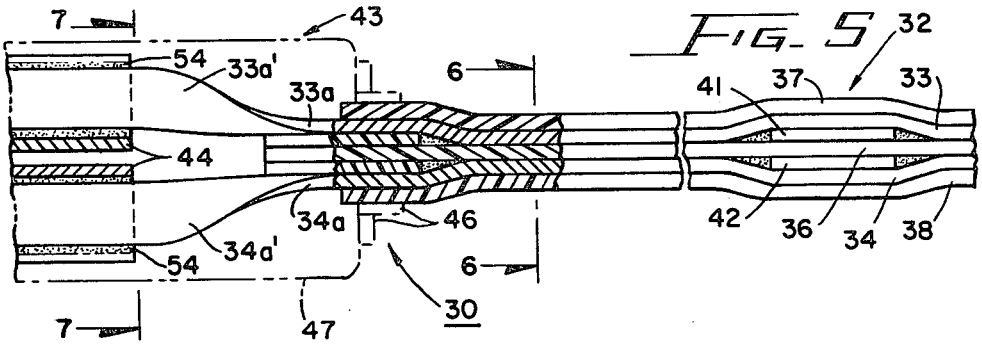
FIG. 5 is a side elevational view, partially in section, of a second preferred flat cable assembly wherein the cable comprises upper and lower arrays of offset ribbon-like conductors, and wherein the stripped, terminated ends of the corresponding conductors in each array are shown twisted approximately 90 degrees, and optionally shifted laterally relative to each other so as to be brought into alignment not only with each other, but with the respectively associated conductor-receiving receptacles of the solder-type connector of FIG. 1 in accordance with the principles of the present invention.
Figure 6:
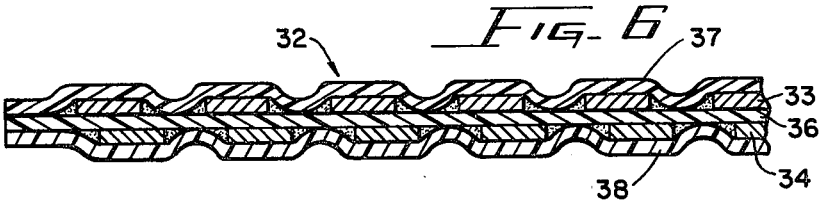
FIG. 6 is a fragmentary cross-sectional view of the flat cable of FIG. 5, taken along the line 6—6 of that FIG.

It should be appreciated that while the invention is described in detail herein primarily in regard to connecting flat cable, having ribbon-like conductors, to solder-type connectors having conductor-receiving solder cups or receptacles, the methods employed to terminate and connectorize such flat cable are also applicable for use with solderless connectors.

With particular reference now to FIGS. 1–4, there is depicted a connectorized flat cable assembly 10 comprised, in part, of a flat cable 12 having a single array of ribbon-like conductors 13 laminated between two thin plastic films 16 and 17, as best seen in FIG. 2. Such conductors are typically made of copper, and the insulative films may be formed out of any one of a number of different suitable plastic materials, one preferred material being polyester. As illustrated, the terminating end of the flat cable 12 is connected to a conventional connector 18 of the solder type, which has a plurality of conductor-receiving solder cups or receptacles 19, best seen in FIG. 4. Associated with a housing 21 of the connector is a strain relief 23, shown only schematically, that is adapted to firmly couple the connector to an unstripped end portion of the cable 12. The strain relief may take any one of a number of different conventional forms, usually being of two-piece construction.

In preparing a given length of the cable 12 for connectorization, short co-extensive terminating regions of the two outer insulative films 16, 17 thereof are initially removed from each end of the cable by any suitable means, such as through the use of a chemical etching process, or a material abrasion process utilizing, for example, a conventional retractably movable abraiding wheel. This exposes an array of short, longitudinally and horizontally disposed, insulation-stripped conductor ends **13*a*** for connectorization.

In accordance with the principles of the present invention, the forward portions **13*a*′ of the stripped conductor ends 13*a* are twisted angularly a predetermined number of degrees from their initial, common hrozontal orientation (as fabricated within the cable) prior to being nested within, and soldered to, the respectively associated receptacles 19 of the connector 18. As illustrated in FIGS. 1, 3 and 4, the conductor end portions 13*a*′** are preferably twisted approximately 90 degrees, for advantageous reasons discussed in greater detail hereinbelow. It should be understood, however, that a lesser amount of angular twist may also be employed to accomplish the beneficial results realized in accordance with the principles of the invention. The conductor twisting operation, of course, may be carried out either manually or with manually operated or fully automated apparatus.

One important result derived from the conductor twisting operation is to position each stripped conductor end portion 13*a'* within an associated connector receptacle 19 such that both major surfaces of the former may be readily contacted by molten solder when the latter is subsequently deposited within the receptacle. Such solder, in solidified form, is identified by the reference numeral 24 in FIGS. 1 and 4.

Considered more specifically, each soldered connection is formed by the solidified solder 24 being in intimate and continuous contact not only with the major surfaces of each twisted conductor end portion 13*a'*, as nested, but also with at least substantially the entire inner U-shaped wall surface area of the associated receptacle 19, by reason of filling all of the otherwise established voids therebetween. In contrast, when such a conductor twisting operation is not employed, the molten solder would normally come in contact with only the upper major side of each then close-fitting horizontally nested conductor end, and that inner sidewall portion of the associated receptacle thereabove. As previously noted, this has generally resulted in a substantial void being established between the underside of each such nested conductor end and the typically U-shaped base region of the associated receptacle. Such limited surface area contact with the solder often has given rise to unsatisfactory conductor-receptacle bonds that may show up either immediately after the soldering operation, or subsequently due to handling or use in the field.

It is thus seen that by twisting the conductor end portions 13*a'* angularly by a predetermined number of degrees prior to their being nested in the respective connector receptacles 19, very reliable and consistent soldered conductor-receptacle connectors are readily formed. In addition, the resulting solder-formed fillets are fully exposed for visual inspection. Such connections may be produced through the use of either manual or automated techniques, performed on either an individual or mass soldering basis, the latter being most readily accomplished through the use of a re-flow soldering operation.

With respect to the degree of angular displacement imparted to the conductor end portions 13*a'*, it should be appreciated, of course, that while they are illustrated as being twisted 90 degrees from their original horizontal positions, any other predetermined degree of angular displacement that will allow the molten solder to freely flow on both major sides thereof, as nested, will provide a reliable soldered connection in accordance with the principles of the invention. To that end, it will be understood that the minimum degree of conductor twist permissible will depend on a number of factors, such as the width and depth of the receptacles, and the width and thickness of the conductors. With such factors taken into account, it is generally desirable that the minimum degree of conductor twist be at least 45 degrees, but preferably in a range of 60 to 90 degrees for best solder connection integrity. Of course, if lateral displacement of the conductor ends is also desired (to increase or decrease the spacings therebetween) for conductor-receptacle alignment, conductor end angular displacement as close to 90 degrees as possible is normally sought in order to overcome the aforementioned otherwise relatively high elastic moduli exhibited by the ribbon-shaped conductors whenever they remain confined within their major common plane, as fabricated in the cable.

Twisting the ribbon-shaped conductor ends 90 degrees can be of particular advantage in the connectorization of a second preferred flat cable assembly embodiment illustrated in FIGS. 5–8. In this latter embodiment, a cable assembly 30 includes a peculiarly constructed flat cable 32, adapted primarily for under-carpet wiring applications, comprised of two slightly offset arrays of rectangularly shaped conductors 33, 34, best seen in FIG. 6, which are separated by a center plastic film 36, with each array being laminated between the center film and a respectively adjacent one of two outer films 37 or 38. A spaced array of aligned pairs of insulative isolating strips 41, 42 are also preferably incorporated in the cable 32 so as to facilitate the insulation-stripping of the conductor ends thereof, considered in greater detail hereinbelow. For further details as to the unique construction of the flat cable 32, and the operating characteristics realized therewith, which are not of particular concern with respect to an understanding of the principles involved in the present invention, attention is directed to the aforementioned copending application of W. A. Elliott et al.

Figure 8:
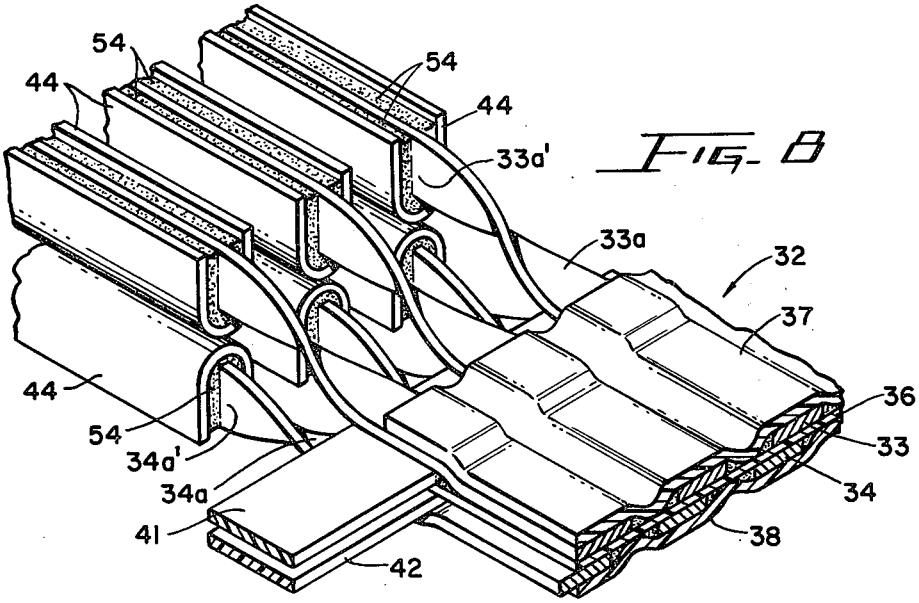
FIG. 8 is an enlarged, fragmentary perspective view of a portion of the cable assembly of FIG. 5, and illustrates the manner in which the stripped and twisted conductor ends of the cable are nested in, and soldered to, respectively associated receptacles of the connector.

As also depicted in FIG. 5, the terminating end of the flat cable 32 is connected to a conventional connector 43 of the solder type which has a plurality of typically U-shaped conductor-receiving solder cups or receptacles 44, best seen in FIG. 8. Also forming a part of the cable assembly 30 is a suitable strain relief 46, shown only schematically, that is firmly secured to an unstripped portion of the cable near the terminating end thereof, and to a rearward portion of the connector housing 47.

In preparing a given length of the cable 32 for connectorization, short co-extensive terminating regions of the two outer insulative films 37, 38 thereof are initially removed from each end of the cable by any suitable means, such as through the use of a conventional material abraiding or chemical etching process. This exposes the outer major surfaces of two short, longitudinally and horizontally disposed arrays of conductor ends 33*a*, 34*a*.

In order to facilitate complete insulation-stripping of the conductor ends in accordance with the principles disclosed in the aforementioned co-pending Elliott et al. application, a pair of the above-noted insulative isolating strips 41, 42, preferably of a suitable plastic material, are employed. More specifically, the isolating strips are positioned transversely across, and respectively on opposite sides of, the center film 36, in aligned pairs, during the fabrication of the cable 32. Such pairs of isolating strips are positioned at each of a succession of predetermined spaced terminating sites along the fabricated cable, such as at 5, 10, or 15 ft. intervals. Depending on the choice of plastic material employed to form the isolating strips 41, 42, and on whether an adhesive backing is initially applied thereto, such strips may either be permanently or lightly bonded to the center film 36 in the case of effecting soldered conductor-receptacle connections. In either case, the inner major surfaces of the otherwise insulation-stripped conductor ends 33*a*, 34*a*, initially in contact with the respectively associated isolating strips 41, 42, may be readily peeled therefrom so as to completely expose the conductor ends for connectorization.

Prior to that operation, however, as well as the conductor twisting operation of particular concern herein, a portion of the resulting free end of the center film 36, together with any co-extensive forward portions of the terminating pair of isolating strips 41, 42 that may remain bonded thereto, are generally simultaneously trimmed back a short distance from the free ends of the conductors, as illustrated in FIGS. 5 and 8, so as to continue to provide effective electrical shielding between and along the most closely spaced regions of the stripped arrays of conductor ends, while at the same time facilitating the soldered securement of the latter to the connector receptacles 44.

In accordance with the principles of the present invention, and as in the case of the first embodiment, forward stripped conductor end portions 33*a'* and 34*a'* are twisted angularly a predetermined number of degrees, preferably in a range of 60 to 90 degrees, prior to being nested within, and soldered to, the respectively associated receptacles 44 of the connector 43. Such a twisting operation may either be performed manually, or with manually operated or fully automated apparatus. In the case of using conductor twisting apparatus, such an operation may be performed on the stripped conductor ends of either one or both arrays simultaneously.

Figure 7:
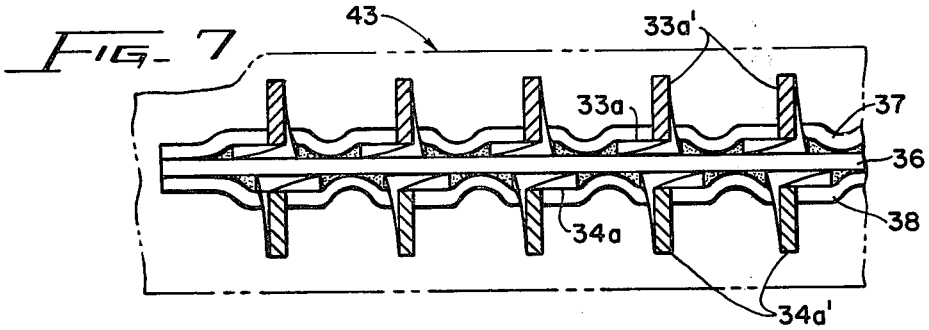
FIG. 7 is a fragmentary cross-sectional view of the flat cable of FIG. 5, taken along the line 7—7 of that FIG., showing the forward portions of the stripped conductor ends after having been twisted approximately 90 degrees, and also after having been optionally displaced laterally relative to each other so as to be brought into aligned registry, in order to facilitate their connectorization.

With respect to connectorizing the cable 32, it may often be imperative, depending on the type, dimensions and spatial relationship of the connector receptacles 44 (or mating elements of any other type), that the two initially offset arrays of stripped and twisted conductor end portions 33*a'*, 34*a'* be brought into corresponding registry for connectorization, as best seen in FIG. 7. This would most often be necessary because the overlying/underlying arrays of receptacles in conventional solder-type connectors are in exact registry, as illustrated in FIG. 8. Concomitantly, should the center line-to-center line spacings between the conductors and the receptacles also be different, then the lateral spacings between adjacent conductors in each array might also have to be either increased, or decreased, so as to become compatible with the corresponding array of receptacles in a given connector.

In either of the above cases, it is normally desirable that the exposed terminating conductor end portions 33*a'*, 34*a'* be twisted as close to 90 degrees as possible, prior to any appreciable lateral displacement and ultimate nesting of the conductors within the respectively aligned receptacles, as illustrated in FIGS. 5, 7 and 8. With such 90 degree twists being effected, the conductor ends may be readily displaced laterally without encountering the relatively high elastic moduli otherwise exhibited by the conductors if they remained in their common horizontal plane, as laminated within the cable. It is appreciated, of course, that suitable fixturing may be utilized to effect the necessary angular twisting, as well as any desired lateral displacement of the conductor ends, prior to their being nested in the respective connector receptacles 44.

Regardless how the stripped conductor end portions 33*a'*, 34*a'* are twisted, and optionally laterally displaced, upon being nested in the respectively aligned receptacles 44, molten solder is deposited in the receptacles utilizing either conventional manual or automated techniques performed on either an individual or mass soldering basis. The subsequently solidified solder in each receptacle, identified by the reference numeral 54, and as best seen in FIG. 8, advantageously is in intimate and continuous contact with both major surfaces of each twisted conductor end portion 33*a'* or 34*a'*, because of the re-oriented position thereof. The solder is also in contact with at least substantially all of the inner U-shaped sidewall surface area of the associated receptacle 44, by reason of filling the otherwise defined spaces or void between the latter and the nested end of the conductor. Such soldered conductor-receptacle connections, as previously noted, have been found to be very reliable and consistently achieved in practice.

After the soldering operation, the aforementioned strain relief 46, depicted in FIG. 5, is secured by any suitable means to an unstripped end region of the cable 32, and normally to a rearward portion of the connector housing 47, so as to prevent any possible detrimental tensile forces from being established between the interconnected conductor ends and the respectively associated connector receptacles.

While the flat cable connectorization methods and embodiments described and illustrated hereinabove have primarily involved the use of connectors of the solder type, it is readily apparent, of course, that the invention is also applicable for use with connectors of the solderless type. For example, FIG. 9 illustrates a fragmentary portion of a cable assembly 60 comprised of a cable 62, with the conductors 63 thereof (only one shown) having insulation-stripped ends 63*a* and twisted end portions 63*a'* secured to connector contacts 64 (only one shown) of the solderless type. Such contacts preferably have a conductor-receiving slot 64*a* that is vertically oriented so as to not only facilitate conductor insertion, but to minimize the required lateral spacing between contacts, particularly if the latter are staggered and arranged in partially overlapped relationship. Alternatively, each contact 64, of course, could also be comprised of two separate mutually disposed and resiliently biased portions that define a slot adapted to frictionally engage a conductor end when inserted therebetween.

In either case, the ribbon shaped conductors 63 normally must be twisted 90 degrees, with or without any accompanying lateral displacement for purposes of connector alignment, in order to effect reliable solderless connections with the illustrative contacts 64 in accordance with the principles of the present invention.

While several related and preferred flat cable-connector assemblies, as well as methods for terminating and connectorizing the cable thereof, have been disclosed herein, it is obvious that various modifications may be made to the present illustrative embodiments and methods of the invention, and that a number of alternative related embodiments and methods could be devised by one skilled in the art without departing from the spirit and scope of the invention.

What is claimed is:

1. A method of connectorizing a terminated end of a given length of flat cable having two laterally disposed, overlying/underlying arrays of insulated ribbon-like conductors, with the major plane of each conductor lying within the major plane of the cable, wherein said two arrays are respectively laminated between a common insulative center film and an associated one of two opposite side outer insulative films, and wherein two laterally disposed isolating strips of non-conductive material are respectively positioned on opposite sides of said center film in alignment, and interposed between the latter and the adjacent one of said two arrays of conductors at each predetermined termination site along said cable, as fabricated, said isolating strips being of a material that will not bond to said conductors, said method comprising the steps of:

stripping the insulation from the conductors along short, longitudinally disposed end regions thereof at the terminated end of the cable, said stripping step further including the step of peeling at least a substantial longitudinally disposed segment of each otherwise stripped conductor end region in each array from the then co-extensive and contacting one of said isolating strips so as to completely expose each such conductor end segment;

angularly twisting at least a forward portion of the respectively stripped conductor end segments a predetermined number of degrees from their original orientation within the cable, and securing the twisted end portions of the conductors to respectively aligned mating elements of an associated connector so as to form an interconnected flat cable-connector assembly.

2. A method in accordance with claim 1 wherein corresponding ones of the conductors in said two arrays as confined in said cable are offset a predetermined distance relative to each other, and wherein said method further includes the step of laterally displacing the stripped and twisted conductor end portions in said two arrays relative to each other so as to bring the corresponding ones of the conductor end portions in said two arrays into aligned pairs.

3. A method in accordance with claim 2 wherein said step of angularly twisting the end portions of said stripped conductors in each array results in their being positioned approximately perpendicular to their original positions as confined within the cable, and wherein said lateral displacing step occurs after the twisting step so that the stripped conductor end portions exhibit a lower elastic moduli which facilitates their lateral displacement.

4. A method in accordance with claim 1 wherein said conductor securing step comprises inserting the twisted end portions of said conductors in each array into a separate array of respectively associated connector elements in the form of open top solder receptacles, the latter arranged in two overlying/underlying arrays, and depositing molten solder within each receptacle so as to fill the voids established between the major surfaces of each nested and twisted conductor end portion and the immediately adjacent inner wall surface areas of the associated receptacle.

5. A method in accordance with claim 4 wherein said step of angularly twisting the end portions of said stripped conductor end segments results in their being re-oriented approximately 90 degrees from their original positions as confined within the cable.

6. A method in accordance with claim 3 wherein said conductor securing step comprises force-fit inserting the twisted and stripped end portions of said conductors into respectively associated solderless connector elements of the type having at least a conductor-receiving resiliently biased slot.

7. A method in accordance with claim 5 wherein corresponding ones of the conductors in said two arrays as confined in said cable are offset a predetermined distance relative to each other, and wherein said method further comprises the step of laterally displacing the stripped and twisted conductor forward end portions in said two arrays relative to each other so as to bring the corresponding ones of the conductor end portions in said two arrays into vertically aligned pairs.

8. A method in accordance with claim 1 further including the step of trimming off at least a portion of the free end of the center film, and any portions of the then forward pair of isolating strips co-extensive therewith, after the step of peeling the conductor end segments in each array from the respectively associated one of said pair of isolating strips.

9. A method of connectorizing a terminated end of a flat cable of given length having two laterally disposed arrays of rectangularly shaped conductors, wherein said arrays are in overlying/underlying relationship, respectively laminated between a common insulative center film and an associated one of two opposite side outer insulative films, with the major surfaces of the conductors in each array being oriented within the major plane of the fabricated cable, and wherein during the fabrication of the cable a spaced array of insulative isolating strips are positioned and secured on each side of, and extend transversely across, the center film, corresponding isolating strips on opposite sides of the center film being aligned in pairs at each predetermined spaced cable termination point therealong, and of a material that allows the conductors in each array that are then co-extensive and in contact with one of said isolating strips to be readily separated therefrom, for connectorization, said method comprising the steps of:

stripping a short end section of each outer film from the terminated end of the cable, so as to expose the outer major surfaces of the conductors in each array along short, longitudinally disposed terminated end regions thereof that are then at least substantially longitudinally co-extensive with an associated one of the pair of isolating strips;

peeling at least a substantial segment of the previously partially exposed end region of each conductor in each array from the associated one of said pair of isolating strips;

angularly twisting at least a forward portion of each then fully exposed conductor end segment in each array a predetermined number of degrees from the original orientation thereof within the cable, and securing the twisted end portions of the conductors in each array to respectively aligned ones of an array of mating elements of an associated connector so as to form an interconnected flat cable-connector assembly.

10. A method in accordance with claim 9 wherein said conductor securing step is effected by inserting the twisted end portions of said conductors in each array into respectively associated connector elements in the form of U-shaped solder receptacles arranged in two overlying/underlying arrays, and depositing molten solder within each receptacle so as to fill the voids established between the major surfaces of each twisted and nested conductor end portion and the immediately adjacent inner wall surface area of the associated receptacle.

11. A method in accordance with claim 10 wherein said step of angularly twisting the end portions of said stripped conductor end segments in each array results in their being re-oriented approximately 90 degrees from their original positions as confined within the cable.

12. A method in accordance with claim 11 wherein corresponding ones of the conductors in said two arrays as confined in said cable are offset a predetermined distance relative to each other, and wherein said method further includes the step of laterally displacing the stripped and twisted conductor forward end portions in said two arrays relative to each other so as to bring the corresponding ones of the conductor end portions in said two arrays into vertically aligned pairs.

13. A method in accordance with claim 12 further including the step of trimming off at least a portion of the free end of the center film, and any portions of the then forward pair of isolating strips co-extensive therewith, after the step of peeling the end segments of the conductors in each array from the respectively associated one of said pair of isolating strips.

14. A method of preparing a terminated end of a flat cable of indefinite length for connectorization, wherein the cable has two laterally disposed, overlying, underlying arrays of insulated ribbon-like conductors, with the major plane of each conductor lying within the major plane of the cable, wherein said two arrays are laminated between respectively associated outer insulative films and an insulative common center film, and wherein two laterally disposed isolating strips of nonconductive material are respectively positioned on opposite sides of said center film in alignment, and interposed between the latter and the adjacent one of said two arrays of conductors at each predetermined termination site along said cable, as fabricated, said isolating strips being of a material that will not bond to said conductors, said method comprising the steps of:

stripping the insulation from a short, longitudinally disposed end region of each conductor at the terminated end of the cable, said stripping step further including the step of peeling at least a substantial longitudinally disposed segment of each otherwise stripped conductor end region in each array from the then co-extensive and contacting one of said isolating strips so as to completely expose said conductor end segments for subsequent connectorization, and angularly twisting at least a forward portion of each stripped conductor end segment a predetermined number of degrees from the original orientation thereof within the cable so as to facilitate the subsequent connectorization of each conductor end portion to an associated connector.

15. A method in accordance with claim 14 wherein said step of angularly twisting the respective forward end portions of said conductors in said two arrays results in their being positioned approximately perpendicular to their original positions as confined within the cable.

16. A method in accordance with claim 15 wherein corresponding ones of the conductors in said two arrays as confined within said cable are offset a predetermined distance relative to each other, and wherein said method further includes the step of laterally displacing the stripped and twisted conductor end portions in said two arrays relative to each other so as to bring the corresponding ones of the conductor end portions in said two arrays into aligned pairs for subsequent connectorization to an associated connector.

* * * * *